US006733941B1

(12) United States Patent
Terauchi et al.

(10) Patent No.: US 6,733,941 B1
(45) Date of Patent: May 11, 2004

(54) RESIN COMPOSITION FOR TONER AND TONER

(75) Inventors: Tomoya Terauchi, Yokohama (JP); Takashi Yamamoto, Yokohama (JP); Kenji Uchiyama, Yokohama (JP); Hiroyuki Takei, Yokohama (JP)

(73) Assignee: Mitsui Chemicals, Inc., Tokyo (JP)

( * ) Notice: Subject to any disclaimer, the term of this patent is extended or adjusted under 35 U.S.C. 154(b) by 0 days.

(21) Appl. No.: 10/130,054

(22) PCT Filed: Nov. 15, 2000

(86) PCT No.: PCT/JP00/08046

§ 371 (c)(1),
(2), (4) Date: May 15, 2002

(87) PCT Pub. No.: WO01/37054

PCT Pub. Date: May 25, 2001

(30) Foreign Application Priority Data

Nov. 16, 1999 (JP) ..... 11/325438

(51) Int. Cl.[7] ..... G03G 9/087

(52) U.S. Cl. ..... 430/108.8; 430/110.3; 430/111.4; 430/124

(58) Field of Search ..... 430/108.8, 110.3, 430/111.4, 124

(56) References Cited

U.S. PATENT DOCUMENTS

| | | | | |
|---|---|---|---|---|
| 4,554,303 A | * | 11/1985 | Petke et al. | 524/277 |
| 4,888,264 A | | 12/1989 | Matsumoto et al. | |
| 4,917,982 A | | 4/1990 | Tomono et al. | |
| 5,547,799 A | | 8/1996 | Yoshie et al. | |
| 5,629,122 A | | 5/1997 | Tanikawa et al. | |
| 5,702,859 A | | 12/1997 | Kubota | |
| 5,780,197 A | | 7/1998 | Kubota | |

FOREIGN PATENT DOCUMENTS

| | | |
|---|---|---|
| JP | 60-15646 A | 1/1985 |
| JP | 61-160761 A | 7/1986 |
| JP | 5-241971 A | 9/1993 |
| JP | 6-130714 A | 5/1994 |
| JP | 8-314181 A | 11/1996 |
| JP | 11-15197 A | 1/1999 |
| JP | 11-24310 A | 1/1999 |

* cited by examiner

*Primary Examiner*—John L Goodrow
(74) *Attorney, Agent, or Firm*—Burns, Doane, Swecker & Mathis, LLP

(57) ABSTRACT

A resin composition for toners which comprises: (A) a wax composition comprising an ethylene polymer having a melt index of from 0.1 to 100 as measured at 190±0.4° C. and a paraffin wax having a melting point of from 70° C. to 120° C. or a Fisher-Tropsch wax having a melting point of from 70° C. to 120° C.; and (B) a binder resin for toners.

8 Claims, No Drawings

RESIN COMPOSITION FOR TONER AND TONER

TECHNICAL FIELD

The present invention relates to a resin composition for toners used for electrophotographs and the like, and a toner.

BACKGROUND ART

Electrophotography in copiers and printers generally uses a process that includes electrostatically forming a latent image on a photosensitive material, developing the latent image by use of a toner, transferring the toner image on a sheet to be fixed, such as a piece of paper, and subsequently pressure fixing the image by a heat roller (the heat roller-fixing process). This heat roller fixing process requires a toner with good fixation properties, which permits fixation at lower temperature, for the improvement of cost efficiency in power consumption and the like, the increase of copying speed, and the prevention of curling of a sheet and the like. In addition, needs for a high quality image and high resolution of a copy image have recently been growing as a result of the development of computers, high resolution TV's, or the like.

In response to such demands, the proposals of the prior art include a product in which the molecular weight and molecular weight distribution of the binder resin are improved. The fixing temperature can be lowered by making low the molecular weight of the binder resin to thereby decrease the melt viscosity thereof. However, lowering the molecular weight decreases the melt viscosity, which simultaneously decreases the cohesive strength of the resin, leading to the problem of causing a toner offset to the fixing roll.

In order to prevent such a problem, a material of a wide molecular distribution, made by mixing a resin of a high molecular weight and a resin of a low molecular weight, is utilized as the binder resin and further the high molecular weight portion of a binder resin is made cross-linked. However, this method increases the viscosity of the resin and thus, on the contrary, makes it difficult to satisfy the fixation properties.

In addition, in order to acquire sufficient fixation properties, a method of decreasing the glass transition temperature of the resin is known; however, in this case, loss of preserving properties of the toner is unavoidable.

Further, in order to impart offset resistance, a method is known in which a polypropylene wax is made contained as a releasing agent. However, the melting point of polypropylene is generally as slightly high as from 130 to 150° C., which causes the problem of not showing its effect at a low fixing temperature.

Furthermore, a method in which a Fischer-Tropsch wax or a microcrystalline wax is made contained as a releasing agent is known in U.S. Pat. Nos. 5,629,122, 5,547,799, 5,702,859 and 5,780,197, etc. These waxes have melting points lower than that of a polypropylene wax, and so they are thought to show releasing agent effects even at lower temperatures. However, even these methods are not sufficient in hot offset properties and thus improvement is required.

So far, a variety of methods were attempted; however, a method in which particularly the aforementioned problems are solved has not provided yet.

DISCLOSURE OF THE INVENTION

The present invention can solve the aforementioned problems of the conventional toners and its object is to provide a resin composition for toners and a toner, excellent in low temperature fixation, offset resistance and preserving properties.

The inventors carried out investigations in order to solve the aforementioned problems; as a result, they have made the inventions described below.

[1] A resin composition for toners comprising:

(A) a wax composition comprising an ethylene polymer having a melt index value of from 0.1 to 100 as measured at 190±0.4° C. and a paraffin wax having a melting point of from 70° C. to 120° C. or a Fisher-Tropsch wax having a melting point of from 70° C. to 120° C.; and (B) a binder resin for toners.

[2] The resin composition for toners according to [1], in which with respect to a whole resin composition for toners, a content of the (A) component is from 0.05% by weight to 15.0% by weight, and a content of the (B) component is from 85.0% by weight to 99.95% by weight; and with respect to a whole (A) component, a content of the ethylene polymer is from 0.01% by weight to 5.0% by weight, and a total content of the paraffin wax and the Fisher-Tropsch wax is from 95.0% by weight to 99.99% by weight.

[3] The resin composition for toners according to [1] or [2], in which the aforementioned binder resin for toners is a styrene polymer (copolymer).

[4] The resin composition for toners according to [3], in which the aforementioned styrene polymer (copolymer) contains a constituent derived from a styrene monomer and a constituent derived from a (meth)acrylate monomer or a (meth)acrylic acid monomer;

the styrene polymer (copolymer) has a glass transition temperature Tg of from 45° C. to 75° C.; and in a chromatogram as measured by GPC, the styrene polymer (copolymer) has an weight-average molecular weight (Mw) of 100,000 or higher, has at least one maximum value or one shoulder in both a molecular weight range of from 3,000 to 12,000 and a molecular weight range of 100,000 or higher, and has a ratio (Mw/Mn) of Mw to number average molecular weight (Mn) of from 15 to 100.

[5] The resin composition for toners according to [1] or [2], in which the aforementioned binder resin for toners is a polyester copolymer.

[6] The resin composition for toners according to [5], in which the aforementioned polyester copolymer has a glass transition temperature Tg of from 45° C. to 75° C.; and in a chromatogram as measured by GPC, the polyester copolymer has an Mw of from 6,000 to 150,000, has at least one maximum valve or one shoulder in the molecular weight range of from 3,000 to 12,000, and has an Mw/Mn of 5 or more.

[7] The resin composition for toners according to any of [1] to [6], in which the resin composition for toners further includes a polyolefin wax.

[8] A toner comprising the resin composition for toners according to any [1] to [7].

The wax composition of the present invention is a mixture containing an ethylene polymer composed of an ethylene monomer as a primary constituent and a paraffin wax or a Fisher-Tropsch wax and preferably further containing a polyethylene wax.

Inclusion of an ethylene polymer composed of an ethylene monomer as the primary constituent in the wax composition allows good dispersion of a paraffin wax or a Fisher-Tropsch wax into the binder resin. This permits the appearance of good fixation and good offset performance. Inclusion of a polyethylene wax is more preferable for better wax dispersion.

A resin composition for toners and a toner of the present invention are made composed as described above and are excellent in offset resistance, fixation and preserving properties.

As a consequence, a resin composition for toners and a toner of the present invention can sufficiently meet recent increasing demands such as speedup of copying, energy conservation and high image quality.

BEST MODE FOR CARRYING OUT THE INVENTION

The present invention will be described in detail.

(Wax)

A paraffin wax of the present invention refers to a mixture of hydrocarbons whose main component is normal paraffin, a mixture that is extracted, separated and highly refined by operation including reduced-pressure distillation of petroleum.

A Fisher-Tropsch wax of the present invention refers to a synthesized wax composed mainly of linear hydrocarbons, which are obtained by, for example, causing water gas, of which main components are carbon monoxide and hydrogen, to react using a catalyst such as cobalt, nickel or an iron-based material at normal pressure at 170 to 250° C. This Fisher-Tropsch wax can be synthesized by means of the Fisher-Tropsch process for utilization or a commercially available one can be utilized.

In the present invention, the melting points of both the paraffin wax and the Fisher-Tropsch wax range from 70° C. to 120° C. If the melting point is too low, the preserving properties of the toner are deteriorated in some cases. On the other hand, too high melting temperature sometimes reduces the fixation of a toner at low temperature.

A resin composition for toners of the present invention may contain polyolefin waxes such as a polyethylene wax and a polypropylene wax. Doing this can improve the dispersion of a wax in a toner. The amount of addition is preferably in the range of from 0 to 10% by weight with respect to the total amount of the resin compositions for toners.

Polyolefin waxes normally have a high viscosity as compared with paraffin waxes and Fisher-Tropsch waxes. When a polyethylene wax, for example, is used as a polyolefin wax, a wax with a melting point of 90 to 130° C. as measured by a DSC method is preferable. In addition, preferably, the viscosity-average molecular weight is less than 8,000 and the crystallinity index is 60% or more. The dispersion of a wax in a toner can be improved by containing in the wax composition a polyethylene wax that satisfies the aforementioned physical properties.

Illustrative examples of trade names corresponding to the aforementioned polyolefin waxes include Hi-waxes 800P, 400P, 200P, 100P, 720P, 420P, 320P, 405MP, 320MP, 4051E, 2203A, 1140H, NL800, NP055, NP105, NP505 and NP805, commercially available from Mitsui Chemicals Inc.; however, the polyolefin waxes are not limited to these products.

Further, the resin compositions for toners of the present invention may include natural waxes such as ceramic wax, rice wax, sugar wax, urushi wax, beeswax, carnauba wax, candelilla wax and montan wax, and the amounts of addition thereof preferably range from 0 to 10% by weight based on the weight of resin composition for toners.

(Ethylene Polymer)

Ethylene polymers of the present invention contain a unit derived from ethylene monomer as the primary constituent. Ethylene polymers preferably contain 90% by weight or more of ethylene monomer. Other monomers constituting the ethylene polymer are preferably alkylene monomers such as propylene, butene, pentene and hexene.

The aforementioned ethylene polymers have a melt index value, as measured at 190±0.4° C. by exerting a load of 2160±10 g based on JIS K 6760, ranging from 0.1 to 100, preferably ranging from 2 to 80. If the melt index value is too low, good fixation performance cannot be obtained in some cases. A too large melt index value does not exhibit good dispersion of the wax in some cases.

Illustrative examples of trade names of the aforementioned ethylene polymers include, for example, Mirason Series available from Mitsui Chemicals Inc.; however, the ethylene polymers are not limited to these products.

The method of manufacturing a wax composition of the present invention comprises feeding a paraffin wax or a Fisher-Tropsch wax and an ethylene polymer composed of ethylene monomer as the primary constituent in specified amounts thereof together with a small amount of a solvent into a mixing vessel and subjecting the mixture to heating, mixing and agitating to thereby mix the mixture uniformly.

(Binder Resin for Toners)

Binder resins for toners in the present invention have the role of binding the components of the resin composition for toners and are preferably styrene polymers (copolymers), polyester copolymers, or the like for utilization.

(Styrene Polymer (Copolymer))

A styrene polymer (copolymer) used in the present invention includes styrene monomer as the primary constituent; in which the styrene polymer (copolymer) preferably contains a constituent derived from styrene monomer and a (meth) acrylate monomer or a (meth)acrylic acid monomer; in which the glass transition temperature (Tg) of the styrene polymer (copolymer) is preferably from 45° C. to 75° C.; and in which in a chromatogram as measured by GPC, the styrene polymer (copolymer) preferably has an weight-average molecular weight (Mw) of 100,000 or higher, preferably has at least one maximum value or one shoulder in both the molecular weight range of from 3,000 to 12,000 and the molecular weight range of 100,000 or higher, and preferably has a ratio (Mw/Mn) of Mw to number average molecular weight (Mn) of from 15 to 100.

Illustrative examples of monomers constituting styrene polymers (copolymers) are indicated below; however, the monomers are not limited to these.

Styrene monomers include, for example, styrene, α-methylstyrene, halogenated styrene, vinyltoluene, 4-sulfonamide styrene and 4-styrene sulfonic acid.

(Meth)acrylate monomers include, for example, methyl (meth)acrylate, ethyl (meth)acrylate, propyl (meth)acrylate, n-butyl (meth)acrylate, isobutyl (meth)acrylate, octyl (meth) acrylate, dodecyl (meth)acrylate, lauryl (meth)acrylate, stearyl (meth)acrylate, cyclohexyl (meth)acrylate, phenyl (meth)acrylate, benzyl (meth)acrylate, furfuryl (meth) acrylate, hydroxyethyl (meth)acrylate, hydroxybutyl (meth) acrylate, dimethylaminomethyl (meth)acrylate, dimethylaminoethyl (meth)acrylate, 2-ethylhexyl (meth)acrylate, 2-chloroethyl (meth)acrylate.

A styrene polymer (copolymer) preferably contains as monomers from 60 to 95% by weight of a styrene monomer and from 5 to 40% by weight of a (meth)acrylate monomer.

Further, illustrative examples of other monomers constituting the styrene polymer (copolymer) include itaconates, such as dimethyl itaconate, dipropyl itaconate, dibutyl itaconate, dioctyl itaconate and diamyl itaconate, maleates and fumarates, such as maleates and fumarates having either linear or branched alkyl groups with the number of carbon atoms of from 1 to 8, diethyl maleate, dipropyl maleate, dibutyl maleate, dipentyl maleate, dihexyl maleate, heptyl maleate, octyl maleate, ethylbutyl maleate, ethyloctyl maleate, butyloctyl maleate, butylhexyl maleate, pentyloctyl maleate, diethyl fumarate, dipropyl fumarate, dibutyl fumarate, dipentyl fumarate, dihexyl fumarate, heptyl fumarate, octyl fumarate, ethylbutyl fumarate, ethyloctyl fumarate, butyloctyl fumarate, butylhexyl fumarate and pentyloctyl fumarate, and unsaturated carboxylic acids and unsaturated dicarboxylic acids such as cinnamic acid, maleic acid, fumaric acid, itaconic acid and 2-vinylnaphthalene, itaconic anhydride, maleic anhydride, acrylamide methylsulfonic acid, acrylamide ethylsulfonic acid, acrylamide n-propylsulfonic acid, acrylamide isopropylsulfonic acid, acrylamide n-butylsulfonic acid, acrylamide-s-butylsulfonic acid, acrylamide t-butylsulfonic acid, acrylamide pentanesulfonic acid, acrylamide hexanesulfonic acid, acrylatnide heptanesulfonic acid, acrylamide octanesulfonic acid, methacrylamide methylsulfonic acid, methacrylamide ethylsulfonic acid, methacrylamide n-propylsulfonic acid, methacrylamide isopropylsulfonic acid, methacrylamide n-butylsulfonic acid, methacrylamide-s-butylsulfonic acid, methacrylamide t-butylsulfonic acid, methacrylamide pentanesulfonic acid, methacrylamide hexanesulfonic acid, methacrylamide heptanesulfonic acid, methacrylamide octanesulfonic acid, divinylbenzene, 1,3-butyleneglycol diacrylate, 1,5-pentanediol diacrylate, neopentylglycol diacrylate, 1,6-hexanediol diacrylate, diethyleneglycol diacrylate, triethyleneglycol diacrylate, tetraethyleneglycol diacrylate, polyethyleneglycol diacrylate, polyethyleneglyco #400 diacrylate, polyethyleneglycol #600 diacrylate, polypropylene diacrylate, N,N methylene bisacrylamide, pentaerythritol triacrylate, trimethylolpropane triacrylate, tetramethylolpropane triacrylate, 1,4-butanediol diacrylate, diethyleneglycol dimethacrylate, 1,3-butyleneglycol dimethacrylate, 1,5-pentanediol dimethacrylate, neopentylglycol dimethacrylate, 1,6-hexanediol dimethacrylate, diethyleneglycol dimethacrylate, triethyleneglycol dimethacrylate, tetraethyleneglycol dimethacrylate, polyethyleneglycol dimethacrylate, polyethyleneglycol #400 dimethacrylate, polyethyleneglycol #600 dimethacrylate, polypropylene dimethacrylate, N,N methylene bismethacrylamide, pentaerythritol trimethacrylate, trimethylolpropane trimethacrylate, tetramethylolpropane trimethacrylate, 1,4-butanediol dimethacrylate and 2,2-bis (4-methacryloxy polyethoxyphenyl) propane.

The styrene polymers (copolymers) can be synthesized by means of well-known polymerization processes such as the bulk polymerization process, the solution polymerization process, the suspension polymerization process and the emulsion polymerization process.

As polymerization initiators in this case, utilized are, for example, t-butylperoxy methacrylate, t-butylperoxy crotonate, di(t-butylperoxy) fumarate, t-butylperoxy allylcarbonate, tri-t-butyl permellitate, tri-t-amino permellitate, tri-t-hexyl permellitate, tri-t-1,1,3,3-tetramethylbutyl permellitate, tri-t-cumyl permellitate, tri-t-(p-isopropyl)cumyl permellitate, tri-t-butyl pertrimesicite, tri-t-amino pertrimesicite, tri-t-hexyl pertrimesicite, tri-t-1,1,3,3-tetramethylbutyl pertrimesicite, tri-t-cumyl pertrimesicite, tri-t-(p-isopropyl)cumyl pertrimesicite, 2,2-bis(4,4-di-t-butylperoxycyclohexyl) propane, 2,2-bis(4,4-di-t-hexylperoxycyclohexyl) propane, 2,2-bis(4,4-di-t-amylperoxycyclohexyl) propane, 2,2-bis(4,4-di-t-octylperoxycyclohexyl) propane, 2,2-bis(4,4-di-a-cumylperoxycyclohexyl) propane, 2,2-bis(4,4-di-t-butylperoxycyclohexyl) butane, 2,2-bis(4,4-di-t-octylperoxycyclohexyl) butane.

Preferably, the styrene polymers (copolymers) have an Mw of 100,000 or higher, have an Mw/Mn of from 15 to 100, and have at least one maximum value or one shoulder in both the molecular weight range of from 3,000 to 12,000 and the molecular weight range of 100,000 or more, in a chromatogram as measured by a GPC. In addition, the Tg of the aforementioned styrene polymers (copolymers) preferably range from 45 to 75° C. Satisfying the aforementioned conditions of Mw, Mw/Mn, the maximum value and Tg leads to very good performance in balance of fixation, offset and preserving properties.

More specifically, a styrene polymer (copolymer) having an Mw of 100,000 or higher, having an Mw/Mn of 15 or more, and having a first maximum value or a first shoulder in the molecular weight range of 3,000 to 12,000 and a second maximum value or a second shoulder in the molecular weight range of 100,000 or higher, is preferably utilized to thereby enhance the cohesive strength of the styrene polymer (copolymer) leading to good offset resistance properties. At the same time, a styrene polymer (copolymer) having an Mw/Mn of less than 100 or having a first maximum value or a first shoulder in the molecular weight range of less than 12,000 is preferably utilized to thereby decrease the viscosity of the styrene polymer (copolymer) leading to good fixation properties. A Tg value of 45° C. or higher is preferably to give a good blocking resistance properties and a Tg value of less than 75° C. is preferably to increase the lowest setting temperature of the toner.

(Polyester Copolymer)

A polyester copolymer used in the present invention is manufactured by utilizing at least one acid component such as terephthalic acid or malonic acid and at least one alcohol component such as ethylene glycol or butylene glycol and by polycondensating them. In addition, in order to manufacture a polyester copolymer of a wider molecular weight distribution, a low molecular weight polyester (a) and a base polyester (b) are prepared in advance and are subsequently mixed and are subjected to a urethane-producing reaction using a polyisocyanate to obtain a resin as well.

As acid components used for the aforementioned polyester copolymers can be utilized any acids used when a polyester copolymer is conventionally manufactured. In addition to the acids indicated above, they include, for example, alkyldicarboxylic acids such as succinic acid, glutaric acid, adipic acid, azelaic acid and sebacic acid, unsaturated dicarboxylic acids such as maleic acid, fumaric acid, citraconic acid and itaconic acid, benzenedicarboxylic acids such as phthalic acid, isophthalic acid and acid anhydrides of these dicarboxylic acids such as phthalic anhydride, and lower alkyl esters. In addition, in order to adjust the molecular weight, monocarboxylic acid and trivalent or more polycarboxylic acids can also be utilized. Preferable monocarboxylic acids include aliphatic monocarboxylic acids such as octanoic acid, decoic acid, dodecanoic acid, myristic acid, palmitic acid and stearic acid, and may be branched or may have unsaturated groups. Further, these aliphatic monocarboxylic acids have the characteristic of lowering the glass transition point, and therefore aromatic monocarboxylic acids such as benzoic acid and naphthalenecarboxylic acid may be used in order to lower the glass transition point. The polycarboxylic acids include trimellitic acid, pyromellitic acid and the anhydrides thereof.

As for alcohol components, any alcohols can be utilized used when a polyester copolymer is conventionally manufactured. Besides the alcohols indicated above, they include, for example, alkyldiols such as 1,3-butylene glycol, 1,4-butylene glycol, 2,3-butanediol, diethylene glycol, triethylene glycol, dipropylene glycol, 1,5-pentanediol, 1,6-hexanediol, neopentyl glycol and 2-ethyl-1,3-hexanediol, alicyclic diols such as hydrogenated bisphenol A and cyclohexanedimethanol, derivatives of bisphenol F or bisphenol S, for example the reaction products of alkyleneoxides, such as ethylene oxide or propylene oxide with bisphenol F or bisphenol S, and aromatic diols, such as lower alkyl dicarboxylates of bishydroxyethylterephthalic acid, bishydroxypropylterephthalic acid and bishydroxyethylterephthalic acid. Furthermore, bisphenol A derivatives, for example,: alkylene oxide adducts of bisphenol A ,such as, the ethylene oxide adduct of bisphenol A and the propylene oxide adduct of bisphenol A are also included. In addition, in order to adjust the molecular weight, monoalcohol and trivalent and more polyols can be utilized. Preferable monols include aliphatic monoalcohols such as octanol, decanol, dodecanol, myristyl alcohol, palmityl alcohol and stearyl alcohol, and may be branched or may have unsaturated groups. Trivalent and more polyols include glycerine, 2-methylpropanetriol, trimethylolpropane, trimethylolethane, sorbitol and sorbitan.

The condensation reaction for obtaining the aforementioned polyester copolymers can be carried out in an inert gas such as nitrogen gas by means of a well-known reaction such as solvent-free high-temperature polycondensation process or solution polycondensation process. For the use ratio of carboxylic acid to alcohol for the reaction, the ratio of the number of the carboxyl group of the former to that of the hydroxyl group of the latter generally ranges from 0.7 to 1.4.

In addition, in the polycondensation for obtaining the aforementioned polyester copolymers, the addition of a catalyst is preferable so as to speed up the reaction. The aforementioned catalysts include tin-based catalysts, more specifically dibutyltin oxide; however, the catalysts are not limited to this species. Further, the amount of addition in this case is preferably from 0.01% by weight to 1.00% by weight.

Preferably, the aforementioned polyester copolymers have a glass transition temperature (Tg) of from 45° C. to 75° C.; in a chromatogram of the copolymers as measured by GPC, the Mw is from 6,000 to 150,000, there is at least one maximum value or one shoulder in the molecular weight range of from 3,000 to 12,000, and the Mw/Mn is 5 or more. Satisfying the aforementioned conditions of Mw, Mw/Mn, the maximum value and Tg leads to very good performance in balance of fixation, offset and preserving properties.

More specifically, a polyester copolymer having a Mw of 6,000 or higher and having an Mw/Mn of 5 or more is preferably utilized to thereby enhance the cohesive strength of the copolymer leading to good offset resistance properties. At the same time, a polyester copolymer having a Mw of 150,000 or lower and having at least one maximum value or one shoulder in the molecular weight range of from 3,000 to 12,000 is preferably utilized to thereby decrease the viscosity of the polyester copolymer leading to good fixation properties. A Tg value of 45° C. or higher is preferably to give a good blocking resistance properties of the toner and a Tg value of less than 75° C. is preferably to increase the lowest setting temperature of the toner.

(Resin Composition for Toners)

In a resin composition for toners of the present invention, with respect to the total resin composition for toners, the content of the wax composition, i.e. the (A) component, preferably ranges from 0.05% by weight to 15.0% by weight, more preferably from 0.5% by weight to 10.0% by weight, and the content of the resin, i.e. the (B) component, preferably ranges from 85.0% by weight to 99.95% by weight, more preferably from 90% by weight to 99.5% by weight.

In addition, with respect to the total (A) component, the content of ethylene polymers is preferably from 0.01% by weight to 5.0% by weight, more preferably 0.1% by weight to 1.0% by weight, and the total content of paraffin waxes and Fisher-Tropsch waxes is preferably from 95.0% by weight to 99.99% by weight, more preferably 99.0% by weight to 99.9% by weight.

Too low a content of a wax composition does not give sufficient fixation properties in some cases. On the other hand, if the content of a wax composition is too large, sufficient preserving properties cannot be obtained.

Methods of mixing a resin with a wax composition in a resin composition for toners of the present invention include (i) a method of dissolving a resin in an organic solvent and mixing a wax composition therein simultaneously and (ii) a method of dissolving a wax composition in monomers to constitute a resin and then polymerizing these monomers.

In addition, to a resin composition for toners of the present invention, besides the aforementioned styrene polymer (copolymer) and polyester copolymer, may be added a resin such as an epoxy resin, a polyurethane resin, a polyamide resin or a silicone resin.

(Toner)

A toner of the present invention includes at least a resin composition for toners, a charge control agent (CCA), a colorant, and a surface treatment, of the present invention. The amount of a resin composition for toners of the present invention is preferably from 50 to 95% by weight with respect to the whole weight of toner.

Components exclusive of a resin composition for toners will be described in the following.

First, for colorants, previously known dyes and pigments can be used, more particularly including Carbon Black, Magnetite, Phthalocyanine Blue, Peacock Blue, Permanent Red, Lake Red, Rhodamine Lake, Hansa Yellow, Permanent Yellow, Benzidine Yellow, Nigrosine Die (C.I. No. 50415), Aniline Blue (C.I. No. 50405), Chalco Oil Blue (C.I. No. azoecBlue 3), Chrome Yellow (C.I. No. 14090), Ultramarine Blue (C.I. No. 77103), Dupont Oil Red (C.I. No. 26105), Orient Oil Red #330 (C.I. No. 60505), Quinoline Yellow (C.I. No. 47005), Methylene Blue Chloride (C.I. No. 52015), Phthalocyanine Blue (C.I. No. 74160), Malachite Green Octhalate (C.I. No. 42000), Lamb Black (C.I. No. 77266), Rose Bengal (C.I. No. 45435), Oil Black and Azo Oil Black. The amount of addition thereof is preferably from 3 to 15 parts by weight with respect to 100 parts by weight of a resin composition for toners.

In addition, as charge control agents can be selected and used, as necessary, well-known charge control agents including nigrosine, quaternary ammonium salts and azo dyes containing metals and the amount of use thereof is normally from 0.1 to 10 parts by weight with respect to 100 parts by weight of a resin composition for toners.

As for surface treatment agent, addition of the surface treatment agent to a toner can improve particle flowability of a developer and further improve the life of the developer due to the fact that the surface treatment is present between the toner and the carrier or between the toners. Illustrative examples include fine particles such as colloidal silica, alumina, titanium oxide, polytetrafluoroethylene, polyvinylidene chloride, polymethyl methacrylate, polystyrene ultrafine particles and silicones, and include, as commercial products, AEROSIL's 130; 200, 200V, 200CF, 200FAD, 300, 300CF, 380, R972, R972V, R972CF, R974, R976, RX200, R200, R202, R805, R812, R812S, TT600, MOX80, MOX170, COK84, titanium oxide T805, titanium oxide P25 (up to here, available from Nippon Aerosil Co., Ltd. and Daicel-Degussa Co., Ltd.), CAB-O-SIL's L90, LM130, LM150, M5, PTG, MS55, H5, HS5, LM150D, M7D, MS75D, TS720, TS610 and TS530 (up to here, available from CABOT Corp.), and particularly, for the surface area of the surface treatment agent, the specific area as measured using the BET method by nitrogen adsorption is desirably 30 $m^2/g$ or larger and more desirably from 50 to 400 $m^2/g$. The amount of surface treatment agent added is preferably 0.1 to 20 parts by weight with respect to 100 parts by weight of a resin composition for toners.

A toner of the present invention may contain a polyolefin wax and the amount thereof is from 0 to 10 parts by weight with respect to 100 parts by weight of a resin composition for toners.

The method of manufacturing a toner containing these materials of the present invention includes sufficiently mixing a resin composition for toners of the present invention, a colorant and, if necessary, other additives by means of a powder mixer, subsequently fusing and mixing the mixture by a kneading machine such as a heating roll, a kneader, or an extruder to sufficiently mix each component, subjecting the resulting mixture to cooling, followed by pulverizing and classifying, then normally collecting the particles of from 8 to 20 $\mu$m and coating the particles with a surface treatment agent by the powder mixing process to obtain a toner.

To a toner of the present invention can also be added a wax composition at the initial stage of powder mixing in the step of manufacturing the toner. The ratio by weight of ethylene polymer (copolymer) to wax composition (ethylene polymer (copolymer): wax composition) is from 99.95 to 85.0: from 0.05 to 15.0.

A toner obtained by the present invention can be used for a variety of developing processes such as the cascade developing process, the magnetic brush process, the powder cloud process and the touchdown developing process, the so-called microtoning process, which uses as a carrier a magnetic toner produced by the pulverizing method, and the so-called bipolar/magnetic toner process, in which necessary toner charge is acquired by friction charging between magnetic toners; however, the applications thereof are not limited to these processes.

In addition, a toner obtained by the present invention can be used for various fixing processes such as the so-called oil-less fusing and oil-applying heat roll processes, the flash fusing process, the oven fixing process and the pressure fixing process.

Further, a toner of the present invention can be used for different kinds of cleaning processes such as the so-called fur brush process and the blade cleaning process.

Detailed descriptions of the present invention will be given using examples in the following; however, the present invention is not limited to these examples. Additionally, hereinafter, "parts" is defined as % by weight, unless otherwise indicated.

The molecular weights and molecular weight distributions of a styrene copolymer and a polyester polymer were evaluated by GPC. Measurement was carried out using a commercially available monodisperse standard polystyrene as a reference under the following conditions.

Detector: SHODEX RI-71S

Solvent: Tetrahydrofuran

Column: KF-G+KF-807L×3+KF800D

Flow rate: 1.0 mL/min

Sample: 0.25% THF solution

Reliability of the measurement was confirmed on the ground that the Mw/Mn of the NBS706 polystyrene sample (Mw=288,000, Mn=137,000, Mw/Mn=2.11) as measured under the aforementioned conditions is 2.11±0.1.

Melting points were determined by evaluating the peak values of wax endotherm by a DSC. The measurement was conducted by firstly raising the temperature to 205° C. and rapidly decreasing it and then raising the temperature from −20° C. to 200° C. at a rate of 10° C./min, using SSC-5200 (Seiko Instruments Inc.).

The method of evaluating toners in these examples will be described in the following.

① Fixation Properties

An unfixed image was prepared with a copier made by modifying a commercial electrophotographic copier and then this unfixed image was fixed using a heat roller fixing apparatus made by modifying the fixing part of a commercial copier. The fixing speed of the heat roller was set at 210 mm/sec and the temperature of the heat roller was made varied by 5° C. for the fixation of the toner. The fixed image thus obtained was rubbed 10 times with a sand eraser (Tombow Pencil Co., Ltd.) under a load of 0.5 Kg. The image concentrations before and after this friction test were measured with a Macbeth reflection densitometer. The lowest fixing temperature when the rate of change in an image concentration at each temperature became 70% or more was regarded as the lowest fixing temperature. Further, the heat roller fixing apparatus used in this case is not equipped with a silicone oil supplying mechanism. Additionally, the measurement was conducted at ambient temperature at normal pressure (temperature 22° C., relative humidity 55%).

Evaluation Results

○: Lowest fixing temperature≦170° C.

Δ: 190° C.≧lowest fixing temperature>170° C.

X: Lowest fixing temperature>190° C.

② Offset Resistance Properties

The evaluation of offset resistance properties is based on the aforementioned measurement of the lowest fixing temperature. The operation of preparing an unfixed image using the aforementioned copier, subjecting the transferred toner image to fixing treatment by the aforementioned heat roller fixing apparatus and subsequently transporting a blank sheet of a transfer paper to the heat roller fixing apparatus under similar conditions to visually observe whether or not toner spots are generated on the transfer paper, was repeated under a condition in which the setting temperature of the heat roller of the aforementioned heat roller fixing apparatus was made to increase one by one; as a result, the lowest setting temperature at which a spot due to the toner was generated was regarded as the offset generation temperature. In addition, the experiment was conducted at ambient temperature at normal pressure (temperature 22° C., relative humidity 55%).

○: Offset generation temperature≧240° C.

Δ: 240° C.>offset generation temperature≧220° C.

X: 220° C.>offset generation temperature

③ Blocking Resistance Properties(preserving Properties)

After a sample was allowed to stand for 48 hours at a temperature of 55° C. and a relative humidity of 50%, 5g of the sample was put on a sieve of mesh 150 and was vibrated for 1 minute using a powder tester with the dial of the rheostat set at 3 (Hosokawa Powders Engineering Inst.). The weight left on the sieve of mesh 150 after the agitation was measured to evaluate the residual weight ratio.

○: Less than 20%

Δ: 20% or more and 35% or less

X: more than 35%

Methods of preparing samples provided for evaluation will be described in the following. In addition, all waxes used were commercially available ones.

Wax Composition Preparation 1

Into a mixing vessel were fed 99.95 parts of Fisher-Tropsch wax with a melting point of 95° C. and 0.05 parts of an ethylene polymer (Mirason, available from Mitsui Chemicals Inc.) with a melt index of 3.3, together with a small amount of solvent, and then the material was mixed with heating and agitating to obtain Wax Composition A.

Wax Composition Preparation 2

Wax Composition B was obtained by a method as in Wax Composition preparation 1, except that the amount of an ethylene polymer was 3 parts.

Wax Composition Preparation 3

Wax Composition C was obtained by a method as in Wax Composition Preparation 1, except that the amount of an ethylene polymer was 10 parts.

Wax Composition Preparation 4

Wax Composition D was obtained by a method as in Wax Composition Preparation 1, except that an ethylene polymer with a melt index of 70 (Mirason, available from Mitsui Chemicals Inc.) was utilized.

Wax Composition Preparation 5

Into a mixing vessel were fed 99.90 parts of Fisher-Tropsch wax with a melting point of 95° C., 0.05 parts of an ethylene polymer (Mirason, available from Mitsui Chemicals Inc.) with a melt index of 3.3 and 0.05 parts of a polyethylene wax (Hi-wax 220P, available from Mitsui Chemicals Inc.), together with a small amount of solvent, and then the material was mixed with heating and agitating to obtain Wax Composition E.

Wax Composition Preparation 6

Into a mixing vessel were fed 99.95 parts of a paraffin wax with a melting point of 73° C. and 0.05 parts of an ethylene polymer (Mirason, available from Mitsui Chemicals Inc.) with a melt index of 3.3, together with a small amount of solvent, and then the material was mixed with heating and agitating to obtain Wax Composition F.

In addition, the Fisher-Tropsch wax and the paraffin wax used in Wax Composition Preparation 1 to 6 are designated as Wax G and Wax H, respectively.

Table 1 shows the composition and properties of wax compositions obtained in the aforementioned Wax Composition Preparation 1 to 6 and Wax Composition G and H.

Resin Preparation 1

Into a flask, the air-inside was replaced with nitrogen, were placed 70.0 parts of a styrene monomer and 30.0 parts of n-butyl acrylate and the mixture was heated and kept at 120° C. in an oil bath to polymerize them for 4 hours by bulk polymerization. The polymerization conversion was 32%. Then, to the material was added 120 parts of xylene and to this mixture was continuously added over 10 hours a mixture, as prepared by mixing and dissolving in advance, of 1 part of azobisisobutyronitrile (AIBN) and 80 parts of xylene while keeping the temperature inside the flask at 100° C. and subsequently the material was allowed to react for 2 hours for polymerization completion to thereby obtain a high molecular weight polymer solution of Mn 18,000 and Mw 410,000.

Next, 80 parts of styrene and 20 parts of butyl methacrylate were refluxed for polymerization in the presence of a solvent of xylene using 4 parts of AIBN as a polymerization initiator to thereby obtain a solution of a low molecular weight polymer of Mw 3,200 and Mw/Mn 2.1. The maximum value is given in Table 2.

These two solutions were mixed in a ratio by solid component weight of 1 to 1 and subsequently the solvent thereof was removed at 190° C. at 3 torr of vacuum for 1 hour to obtain the target styrene copolymer. The copolymer thus obtained has an Mw of 210,000, an Mw/Mn of 65 and a Tg of 60° C.

Resin Preparation 2 to 13

A low molecular weight polymer and a high molecular weight polymer having a similar composition as in Resin Preparation 1 were obtained by a method as in Resin Preparation 1, except that the amount of polymer initiator, the polymerization temperature and the ratio of solvent were changed and subsequently solutions of these polymers were mixed with an appropriate ratio and solvent was removed as in Resin Preparation 1 to obtain a styrene copolymer.

Resin Preparation 14

Into a four-necked flask fitted with a reflux condenser, a water separation device, a nitrogen gas-introducing tube, a thermometer and an agitating device were placed 65 parts of Polyol KB300 (Mitsui Chemicals Inc.), 30 parts of isophthalic acid, 5 parts of benzoic acid and 0.05parts of dibutyltin oxide and then dehydration condensation polymerization was carried out at 240° C. while introducing nitrogen into the flask. When the acid value of the reaction product reached a specified value, the product was taken out of the flask and was cooled and pulverized to thereby obtain Polyester Polymer (a).

Next, Polyester Polymer (b) was obtained by a method similar-to the aforementioned one, except that 31 parts of Polyol KB300 (Mitsui Chemicals Inc.), 22 parts of diethyleneglycol (DEG), 3 parts of trimethylolpropane (TMP) and 44 parts of isophthalic acid were fed.

Further, 60 parts of Polyester Polymer (a), 4 parts of Polyester Polymer (b) and 2 parts of tolylene diisocyanate was kneaded in a twin extruder at 180° C. to obtain a polyester polymer.

Table 2 tabulates properties of the resins obtained in Resin Preparation 1 to 14.

EXAMPLE 1

A resin composition for toners was obtained by an operation similar to Resin Preparation 1, except that 3 parts of Wax Composition A was added in the step of solvent removal.

Further, after 87 parts of a resin composition for toners, 8.0 parts of carbon black (MA100, available from Mitsubishi Chemicals Corp.), 1.0 part of a charge control agent (BONTRON S-34, available from Orient Chemical Industries Co., Ltd.) and 3.0 parts of a polypropylene wax (Hiwax NP105, Mitsui Chemicals Inc.) were preliminary mixed with a Henschel mixer, the resultant mixture was kneaded by a twin extruder at 120° C. and then was subjected to cooling, grinding and pulverizing, followed by classification by a classifier to thereby obtain a toner of from 6.0 to 18.0 μm. After that, hydrophobic silica (R-972, available from Aerosil Corp.) was added from the outside so that the ratio was 0.5 parts by weight with respect to 100 parts by weight of the aforementioned toner and then the material was mixed by a Henschel mixer to obtain a toner. The evaluation results of the toner thus obtained are given in Table 3.

EXAMPLES 2 TO 18 AND REFERENCE EXAMPLES 1 TO 6

A toner was obtained by a method similar to the one in Example 1, except that the kind of resin and the kind and amount of an added wax composition were changed. The evaluation results of the toners thus obtained are shown in Table 3.

EXAMPLE 19

The same operation as in the case of Example 1 was conducted and 3 parts of Hiwax NP105 was added in the step of solvent removal and subsequently the solvent was removed as in the case of Resin Preparation 1 for Toners to thereby obtain a resin composition for toners. Then, the operation based on Example 1 was conducted with this resin composition for toners to obtain a toner. The evaluation results of the toner thus obtained are given in Table 3.

EXAMPLE 20

The same operation as in the case of Example 1 was conducted without adding polypropylene wax during kneading to obtain a toner. The evaluation results of the toner thus obtained are given in Table 3.

EXAMPLE 21

A resin composition for toners was obtained by an operation similar to that of Example 14 of Preparing Resin, except that 5 parts of Wax Composition A was added during the condensation polymerization of Polyester Polymer (a). Then, a toner was obtained by a method similar to the case in Example 1. The evaluation results of the toner thus obtained are shown in Table 3.

TABLE 1

| | Wax (1) | | | | | |
|---|---|---|---|---|---|---|
| | Fisher-Tropsch wax | Paraffin wax | Wax (2) Poly ethylene Wax | Ethylene polymer | Melting point of Wax (1) (° C.) | Melt index of ethylene polymer |
| Wax Composition A | 99.95 | | | 0.05 | 95 | 3.3 |
| Wax Composition B | 97 | | | 3 | 95 | 3.3 |
| Wax Composition C | 90 | | | 10 | 95 | 3.3 |
| Wax Composition D | 99.95 | | | 0.05 | 95 | 70 |
| Wax Composition E | 99.90 | | 0.05 | 0.05 | 95 | 3.3 |
| Wax Composition F | | 99.95 | | 0.05 | 73 | 3.3 |
| Wax Composition G | 100 | | | | 95 | |
| Wax Composition H | | 100 | | | 95 | |

TABLE 2

| | Mw | Mw/Mn | Peak of M.W. (1) | Peak of M.W. (2) | Tg (° C.) |
|---|---|---|---|---|---|
| A-1 | 210,000 | 65 | 340,000 | 4,000 | 60 |
| A-2 | 130,000 | 49 | 300,000 | 4,000 | 59 |

TABLE 2-continued

| | Mw | Mw/Mn | Peak of M.W. (1) | Peak of M.W. (2) | Tg (° C.) |
|---|---|---|---|---|---|
| A-3 | 310,000 | 91 | 300,000 | 4,000 | 61 |
| A-4 | 230,000 | 78 | 290,000 | 4,000 | 52 |
| A-5 | 11,000 | 30 | 190,000 | 5,000 | 71 |
| A-6 | 220,000 | 63 | 330,000 | 4,000 | 43 |
| A-7 | 210,000 | 64 | 350,000 | 4,000 | 78 |
| A-8 | 110,000 | 4 | 120,000 | — | 60 |
| A-9 | 370,000 | 110 | 310,000 | 4,000 | 60 |
| A-10 | 90,000 | 25 | 180,000 | 5,000 | 61 |
| A-11 | 190,000 | 95 | 330,000 | 2,000 | 61 |
| A-12 | 210,000 | 26 | 320,000 | 13,000 | 59 |
| A-13 | 110,000 | 30 | 90,000 | 4,000 | 58 |
| A-14 | 18,000 | 12 | 5,400 | — | 58 |

TABLE 3

| | Composition of resin composition for toner | | | Toner evaluation results | | |
|---|---|---|---|---|---|---|
| | Co-polymer | Wax compo-sition | Content of wax compo-sition | Fixation proper-ties | Offset proper-ties | Preser-vation proper-ties |
| Example 1 | A-1 | A | 3 wt % | ○ | ○ | ○ |
| Example 2 | A-1 | A | 10 wt % | ○ | ○ | ○ |
| Example 3 | A-1 | B | 3 wt % | ○ | ○ | ○ |
| Example 4 | A-1 | D | 3 wt % | ○ | ○ | ○ |
| Example 5 | A-1 | E | 3 wt % | ○ | ○ | ○ |
| Example 6 | A-1 | F | 3 wt % | ○ | ○ | ○ |
| Example 7 | A-2 | A | 3 wt % | ○ | ○ | ○ |
| Example 8 | A-3 | A | 3 wt % | ○ | ○ | ○ |
| Example 9 | A-4 | A | 3 wt % | ○ | ○ | ○ |
| Example 10 | A-5 | A | 3 wt % | ○ | ○ | ○ |
| Example 11 | A-6 | A | 3 wt % | ○ | ○ | Δ |
| Example 12 | A-7 | A | 3 wt % | Δ | ○ | ○ |
| Example 13 | A-8 | A | 3 wt % | Δ | Δ | ○ |
| Example 14 | A-9 | A | 3 wt % | Δ | ○ | ○ |
| Example 15 | A-10 | A | 3 wt % | Δ | Δ | ○ |
| Example 16 | A-11 | A | 3 wt % | Δ | Δ | ○ |
| Example 17 | A-12 | A | 3 wt % | Δ | ○ | ○ |
| Example 18 | A-13 | A | 3 wt % | Δ | Δ | ○ |
| Example 19 | A-1 | A | 3 wt % | ○ | ○ | ○ |
| Example 20 | A-1 | A | 3 wt % | ○ | ○ | ○ |
| Example 21 | A-14 | A | 3 wt % | ○ | ○ | ○ |
| Reference Example 1 | A-1 | — | — | X | X | ○ |
| Reference Example 2 | A-1 | G | 3 wt % | Δ | X | ○ |
| Reference Example 3 | A-1 | H | 3 wt % | Δ | X | ○ |
| Reference Example 4 | A-1 | C | 3 wt % | Δ | ○ | Δ |
| Reference Example 5 | A-1 | A | 20 wt % | ○ | ○ | Δ |
| Reference Example 6 | A-14 | — | — | Δ | Δ | ○ |

What is claim is:

1. A resin composition for toners comprising:

(A) a wax composition comprising an ethylene polymer having a melt index value of from 0.1 to 100 as measured at 190±0.4° C. and a paraffin wax having a melting point of from 70° C. to 120° C. or a Fisher-Tropsch wax having a melting point of from 70° C. to 120° C.; and (B) a binder resin for toners.

2. The resin composition for toners according to claim 1, wherein with respect to a whole resin composition for toners, a content of the (A) component is from 0.05% by weight to 15.0% by weight, and a content of the (B) component is from 85.0% by weight to 99.95% by weight; and with respect to a whole (A) component, a content of the ethylene polymer is from 0.01% by weight to 5.0% by weight, and a total content of the paraffin wax and the Fisher-Tropsch wax is from 95.0% by weight to 99.99% by weight.

3. The resin composition for toners according to claim 1, wherein said binder resin is a styrene polymer (copolymer).

4. The resin composition for toners according to claim 1, wherein said styrene polymer (copolymer) contains a constituent derived from a styrene monomer and a constituent derived from a (meth)acrylate monomer or a (meth) acrylic acid monomer;

the styrene polymer (copolymer) has a glass transition temperature Tg of from 45° C. to 75° C.; and in a chromatogram as measured by GPC, the styrene polymer (copolymer) has a weight-average molecular weight (Mw) of 100,000 or higher, has at least one maximum value or one shoulder in both a molecular weight range of from 3,000 to 12,000 and a molecular weight range of 100,000 or higher, and has a ratio (Mw/Mn) of Mw to number average molecular weight (Mn) of from 15 to 100.

5. The resin composition for toners according to claim 1, wherein said binder resin for toners is a polyester copolymer.

6. The resin composition for toners according to claim 5, wherein said polyester copolymer has a glass transition temperature Tg of from 45° C. to 75° C.; and in a chromatogram as measured by GPC, the polyester copolymer has an Mw of from 6,000 to 150,000, has at least one maximum valve or one shoulder in the molecular weight range of from 3,000 to 12,000, and has an Mw/Mn of 5 or more.

7. The resin composition for toners according to claim 1, wherein the resin composition for toners further includes a polyolefin wax.

8. A toner comprising the resin composition for toners according to claim 1.

* * * * *